US007530823B1

(12) United States Patent
Thornton et al.

(10) Patent No.: US 7,530,823 B1
(45) Date of Patent: May 12, 2009

(54) USB MODEM DEVICES WITH A FLIP ANTENNA AND A RETRACTABLE USB CONNECTOR

(75) Inventors: Curtis Wayne Thornton, Raleigh, NC (US); Gerard James Hayes, Wake Forest, NC (US); Koichiro Takamizawa, Cary, NC (US); Brian Francis Mellage, Raleigh, NC (US)

(73) Assignee: Sony Ericsson Mobile Communications AB, Lund (SE)

( * ) Notice: Subject to any disclaimer, the term of this patent is extended or adjusted under 35 U.S.C. 154(b) by 0 days.

(21) Appl. No.: 12/032,245

(22) Filed: Feb. 15, 2008

Related U.S. Application Data

(60) Provisional application No. 61/019,387, filed on Jan. 7, 2008.

(51) Int. Cl.
*H01R 13/44* (2006.01)

(52) U.S. Cl. ..... 439/136; 439/131; 439/142

(58) Field of Classification Search ..... 439/136, 439/131, 138, 141, 142; 361/754, 737; D14/358
See application file for complete search history.

(56) References Cited

U.S. PATENT DOCUMENTS 6,758,689 B1 * 7/2004 Bair et al. ..... 439/136
6,975,274 B2 * 12/2005 Sanchez et al. ..... 343/702
6,979,210 B2 12/2005 Regen et al. ..... 439/131
7,070,425 B2 7/2006 Regen et al. ..... 439/131
7,090,515 B2 8/2006 Regen et al. ..... 439/131
7,462,044 B1 * 12/2008 Regen et al. ..... 439/131
2006/0131431 A1 * 6/2006 Finn ..... 235/492
2006/0155913 A1 * 7/2006 Nishikawa et al. ..... 711/100
2007/0182868 A1 * 8/2007 Yang ..... 348/731
2008/0192149 A1 * 8/2008 Lee ..... 348/725

* cited by examiner

*Primary Examiner*—Hae Moon Hyeon
(74) *Attorney, Agent, or Firm*—Myers Bigel Sibley & Sajovec

(57) ABSTRACT

A Universal Serial Bus (USB) modem device includes a body member and a flip member. The flip member includes an antenna element and is rotatably coupled to the body member for movement about a hinge axis between a closed position and an open position. A USB connector is movably mounted in the body member for movement between an extended position and a retracted position relative to the body member. A linkage mechanism in the body member couples the flip member and the USB connector so that movement of the flip member between the open position and the closed position moves the USB connector between the extended position and the retracted position.

23 Claims, 11 Drawing Sheets

USB MODEM DEVICES WITH A FLIP ANTENNA AND A RETRACTABLE USB CONNECTOR

RELATED APPLICATIONS

The present application claims priority from U.S. Provisional Application No. 61/019,387, filed Jan. 7, 2008, the disclosure of which is hereby incorporated herein in its entirety by reference.

BACKGROUND OF THE INVENTION

The present invention relates to the field of communications, and, more particularly, to mobile terminals.

To provide wireless communications capability to an electronic device, such as a personal computer, not including such a capability, a modem may be coupled to the electronic device. Both internal modems, installed to an internal bus of the electronic device, and external modem devices are available. External interfaces to the electronic device may include, for example, a universal serial bus (USB).

Currently, USB dongle moderns are gaining acceptance for mobile computing applications with laptop computers and the like. There is a desire to produce the smallest (most compact) product for such applications. However, the incorporation of several antenna systems (including main—cellular, diversity, global positioning system (GPS), and/or wireless local area network (WLAN) applications) may greatly impact the overall size of the product.

SUMMARY OF THE INVENTION

Some embodiments of the present invention provide a Universal Serial Bus (USB) modem device including a body member and a flip member. The flip member includes an antenna element and is rotatably coupled to the body member for movement about a hinge axis between a closed position and an open position. A USB connector is movably mounted in the body member for movement between an extended position and a retracted position relative to the body member. A linkage mechanism in the body member couples the flip member and the USB connector so that movement of the flip member between the open position and the closed position moves the USB connector between the extended position and the retracted position.

In some embodiments, the USB modem device includes a circuit board positioned in the body member, a modem circuit on the circuit board and a Radio Frequency connection operatively coupling the antenna to the modem circuitry. The USB connector may be fixedly connected to the circuit board and the circuit board and the USB connector may move together linearly between the extended position and the retracted position. The antenna element may be a loop antenna, a linear antenna and/or the like.

In other embodiments, the RF connection is a direct connection including a contact on the flip member operatively coupled to the antenna and an associated contact on the body member operatively coupled to the modem circuit. The contact on the flip member and the associated contact on the body member may be in contact only in the open position or in contact in both the open and closed positions.

In further embodiments, a first antenna and a second antenna are included in the flip member. The flip member includes a first and second aim. The first arm extends from the hinge axis proximate a first side of the body member to an end thereof displaced from the hinge axis. The first arm includes the first antenna. The second arm extends from the hinge axis proximate a second side of the body member to an end thereof displaced from the hinge axis, opposite the first side. The second aim includes the second antenna. A connecting member extends between the end of the first arm and the end of the second arm. In the closed position, the connecting member is positioned adjacent an end of the body member extending between the first and second side of the body member and covers a USB connector opening in the end of the body member through which the USB connector extends in the extended position. The contact on the flip member may be a first contact operatively coupled to the first antenna and a second contact coupled to the second antenna and the associated contact may be a first associated contact on the first side of the body member and a second associated contact on the second side of the body member.

In other embodiments, the body member further includes a memory card slot in the end of the body member proximate the USB connector opening. The connecting member covers the memory card slot in the closed position. The circuit board further includes a memory card circuit configured to operatively engage a memory card inserted in the memory card slot.

In further embodiments, the linkage mechanism includes a metal shaft extending along the hinge axis to which the flip member is fixedly coupled. The RF connection is a direct connection including a contact on the flip member operatively coupled to the antenna that contacts the metal shaft in both the open position and the closed position. The contact on the flip member may be a spring contact.

In other embodiments, the RF connection is a capacitive coupling including a first electrode on the flip member operatively coupled to the antenna and a second electrode on the body member operatively coupled to the modem circuit. The first and second electrode are capacitively coupled without direct contact therebetween in the open position. The first electrode and the second electrode may be centrally located proximate the hinge axis and the first and second electrode may be capacitively coupled without direct contact therebetween in the closed position and the open position. The first electrode and the second electrode may also be positioned at locations offset from the hinge axis and be capacitively coupled without direct contact therebetween only in the open position.

In further embodiments, the RF connection is an inductive coupling including a first coil on the flip member operatively coupled to the antenna and a second coil on the body member operatively coupled to the modem circuit. The first and second electrode are inductively coupled without direct contact therebetween in the open position. The first coil and the second coil may be centrally located proximate the hinge axis and may be capacitively coupled without direct contact therebetween in the closed position and the open position.

In other embodiments, the body member further includes a memory card slot in the end of the body member proximate the USB connector opening. The connecting member covers the memory card slot in the closed position. The circuit board further includes a memory card circuit configured to operatively engage a memory card inserted in the memory card slot. The circuit board may be a first circuit board and a separate second circuit board. The USB connector may be connected to the first circuit board and the modem circuit may be on the first circuit board. The memory card circuit may be on the second circuit board. The first circuit board may be electrically connected to the second circuit board.

In yet further embodiments, the linkage mechanism is a rack and gear mechanism that translates rotational movement of the flip member between the open and closed position to linear movement of the USB connector between the extended and retracted position. The rack and gear mechanism may include a gear coupled to the flip member for rotation therewith about the hinge axis and a sliding member. The sliding member includes a rack member thereon. The rack member engages the gear. The sliding member is coupled to the USB connector for linear movement therewith when rotation of the gear linearly drives the rack member.

In other embodiments, the rack and gear mechanism includes a first gear coupled to the first arm proximate the first side of the body member for rotation therewith about the hinge axis and a second gear coupled to the second arm proximate the second side of the body member for rotation therewith about the hinge axis. The sliding member includes a first and second rack member thereon. The first rack member engages the first gear and the second rack member engages the second gear. The sliding member is coupled to the USB connector for linear movement therewith when rotation of the first gear linearly drives the first rack member and rotation of the second gear linearly drives the second rack member.

In yet further embodiments, methods for configuring an electronic device for wireless communication are provided. A handheld USB modem device includes a flip member including an antenna element and a USB connector linked thereto for linear movement to an extended position responsive to rotation of the flip member to an open position is provided. The flip member covers an opening through which the USB connector linearly travels in a closed position of the flip member. The flip member is rotated to the open position to uncover the opening and extend the USB connector to the extended position. The extended USB connector is inserted into a USB port of the electronic device to activate the USB modem device and configure the electronic device for wireless communication through the USB modem device. Rotating the flip member may also electronically couple the antenna element to a modem circuit of the USB modem device.

DETAILED DESCRIPTION OF EMBODIMENTS OF THE INVENTION

Figure 1A:
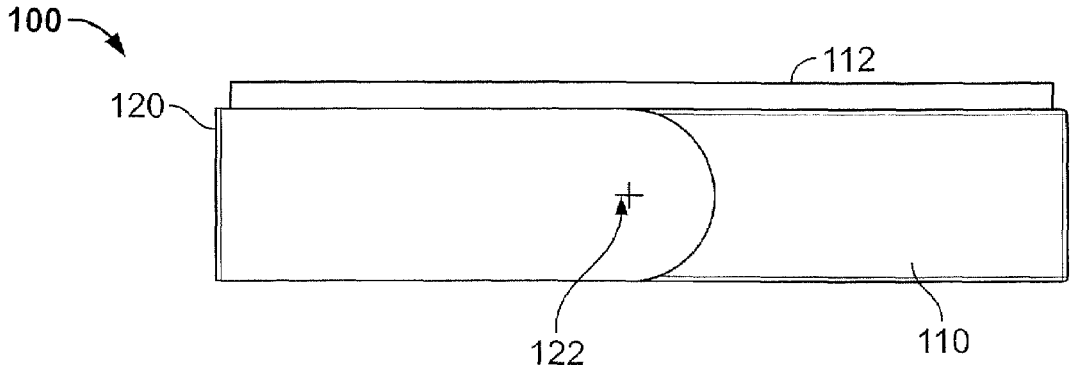
FIG. 1A is a side view of a USB modem device according to some embodiments of the present invention with a USB connector in a closed position.

The invention now will be described more fully hereinafter with reference to the accompanying drawings, in which illustrative embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout. As used herein, the term "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that, although the terms first, second, etc. may be used herein to describe various elements, these elements should not be limited by these terms. These terms are only used to distinguish one element from another.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and this specification and will not be interpreted in an idealized or overly formal sense unless expressly so defined herein.

Some embodiments of the present invention provide a unique combination of flip antenna assembly (also referred to herein as a "flip member") with an integrated sliding USB mechanism that may allow for an extremely compact mechanical size of the product.

Some embodiments of the present invention provide a device including a flip antenna assembly with an integrated, retractable USB connector. Some embodiments of such a modem device (dongle) with a retractable USB connector and flip antenna will be further described with reference to FIGS. 1A through 12C. Note, there are several methods to achieve the mechanical sliding action of the USB contact, with one option (using a rack and gear mechanism) being described with reference to the figures. However, it will be understood that the present invention is not limited to the use of a rack and gear mechanism for coupling the movable antenna to the body of the modem device so as to move the USB connector between the extended (open) and retracted (closed) positions thereof. Similarly, there are several methods to implement antenna/RF connections with several general concepts presented (including direct connections, inductive connections, and capacitive connections) in the figures. Thus, such connections may include offset contacts, center contacts, capacitive coupling and/or inductive coupling. However, the present invention is not limited to the connection types illustrated for descriptive purposes in the figures.

Figure 1B:
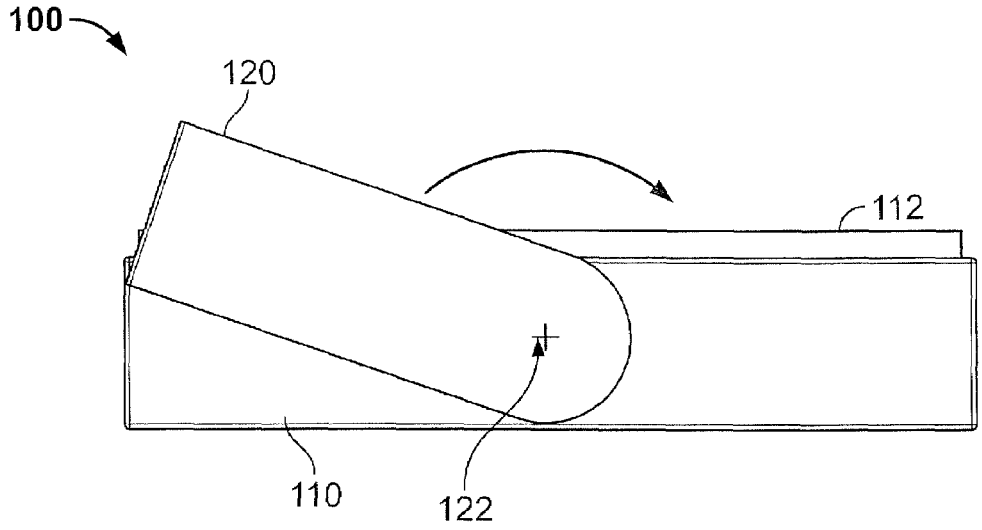
FIG. 1B illustrates the USB modem device of FIG. 1A with the USB connector in an intermediate position.
Figure 1C:
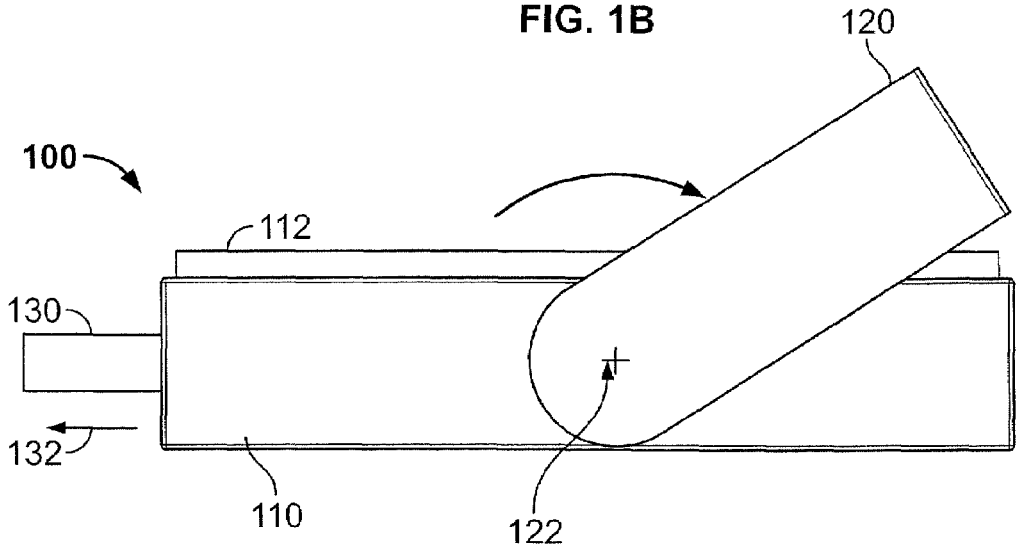
FIG. 1C illustrates the USB modem device of FIG. 1A with the USB connector rotated to the open position.

FIGS. 1A through 1C illustrate side views of a USB modem device according to some embodiments of the present invention. FIG. 1A illustrates the USB connector stowed in a closed (retracted) position. FIG. 1C illustrates the USB connector rotated to the open/engaged position with the antenna element engaged (operatively coupled) to internal circuitry in the USB modem device. FIG. 1B illustrates the USB connector in an intermediate position.

As seen in FIG. 1A, the USB modem device 100 includes a body member 110 and a flip member 120. The flip member 120 is rotatably coupled to the body member 110 for rotational movement about a hinge axis 122 between a closed position, seen in FIG. 1A, and an open position, seen in FIG. 1C. Also shown in the embodiments of FIGS. 1A through 1C, is a cover 112 on the body member 110. FIG. 1B illustrates the flip member 120 in transition between the closed position of FIG. 1A and the open position of FIG. 1C.

As seen in FIG. 1C, movement of the flip member 120 to the open position linearly extends a USB connector 130 in a direction 132. As such, the USB connector 130 is extended from inside the body member 110 to its extended position as seen in FIG. 1C, where it may be plugged into a USB port of an electronic device or the like to provide wireless communications capabilities to the electronic device. As will be further described herein, movement of the flip member 120 to the open position of FIG. 1C may further operatively couple the antenna element or elements in the flip member 120 to modem circuitry inside the body member 110.

Figure 2:
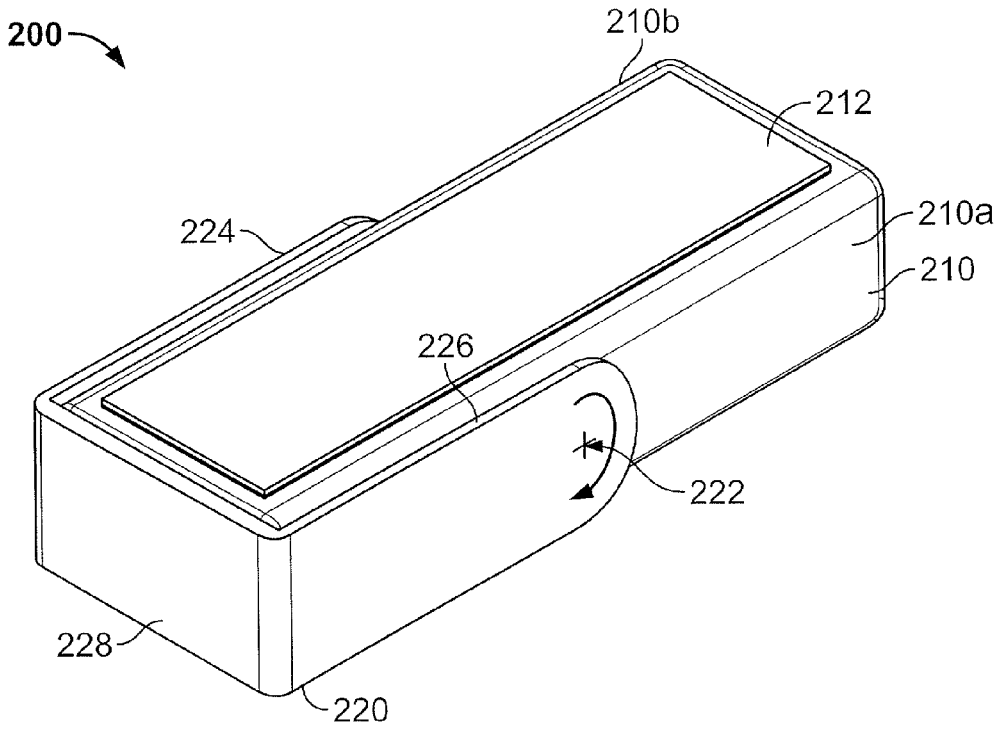
FIG. 2 is a perspective view of a USB modem device according to some embodiments of the present invention with a flip member in a closed position.
Figure 3:
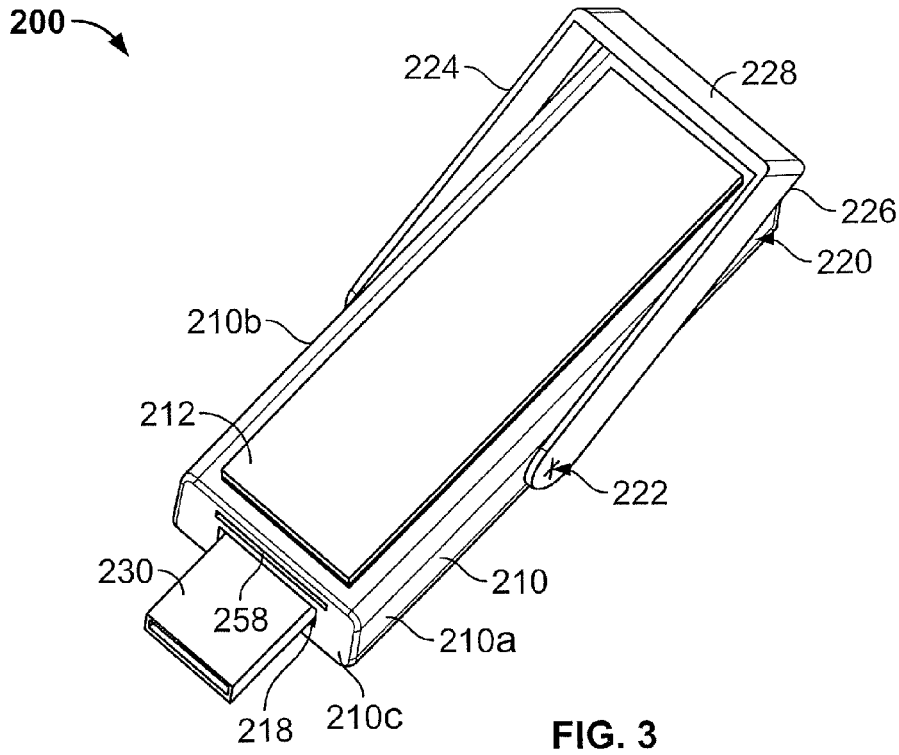
FIG. 3 is a perspective view of the USB modem device of FIG. 2 in an open position.

FIG. 2 is a perspective view of a USB modem device according to some embodiments of the present invention with the flip cover/antenna assembly in a closed (stowed) position covering a USB port and SIM/memory card slot in an end of the body of the USB modem device. The flip cover/antenna assembly ("flip member") is shown rotatably coupled to the body about a pivot point. FIG. 3 is a perspective view of the USB modem device of FIG. 2 in the open position with the antenna element engaged and the USB connector in the extended position. The SIM/memory card slot is shown in FIG. 3 above the USB connector in the same end of the body of the USB modem device.

As shown for the embodiments of FIGS. 2 and 3 the USB modem device 200 includes a body member 210, a flip member 220 and a USB connector 230. A cover 212 is also shown positioned on the body member 210. The flip member 220 is rotatably coupled to the body member 210 for movement about a hinge axis 222 between a closed position, shown in FIG. 2, and an open position, shown in FIG. 3. The hinge axis 222 extends along a width of the body member 210 from a First side 210*a* of the body member 210 to a second side 210*b* of the body member 210. As will be described further later herein, it will be understood that the flip member 220 includes an antenna element or elements that are operatively coupled to modem circuitry inside the body member 210, at least in the open position of FIG. 3, so as to allow wireless communications by an electronic device when the USB modem device 200 is operatively coupled to the electronic device using the USB connector 230.

As with the embodiments of FIGS. 1A through 1C, the flip member 220 is coupled to the USB connector 230 through a linkage mechanism in the body member 210 so that rotational movement of the flip member 220 from the closed position of FIG. 2 to the open position of FIG. 3 linearly extends the USB connector 230 from a retracted position in the body member 220 to an extended position as seen in FIG. 3. More particularly, the USB connector 230 extends through an opening 218 in an end 210*c* of the body member 210. The opening 218 in the end 210*c* is covered by the flip member 220 in the closed position of the flip member as shown in FIG. 2.

Also shown in FIG. 3 is a memory card slot 258 in the end 210*c* of the body member 210. Memory card slot 258 extends along the end 210*c* proximate the USB connector 230 and is also covered by the flip member 220 in the closed position as seen in FIG. 2. A memory card, such as a SIM, may be inserted in the memory card slot 258 and may be used to add additional memory for various purposes to the various circuitry contained in the body member 210 or to enable operation of circuitry requiring such an additional inserted memory card device.

As seen in the embodiments of FIGS. 2 and 3, the flip member 220 includes a first arm 226 and a second arm 224. The first arm 226 extends from the hinge axis 222 proximate the first side 210*a* of the body member 210. The second arm 224 extends from the hinge axis 222 proximate the second side 210*b* of the body member. Ends of the first and second arms 226, 224 displaced from the hinge axis 222 are joined by a connecting member 228 extending between the arms 224, 226. The connecting member 228 in the closed position of FIG. 2 is positioned adjacent the end 210*c* of the body member 210 to cover the USB connector opening 218 and the memory card slot 258 as discussed above.

Figure 4:
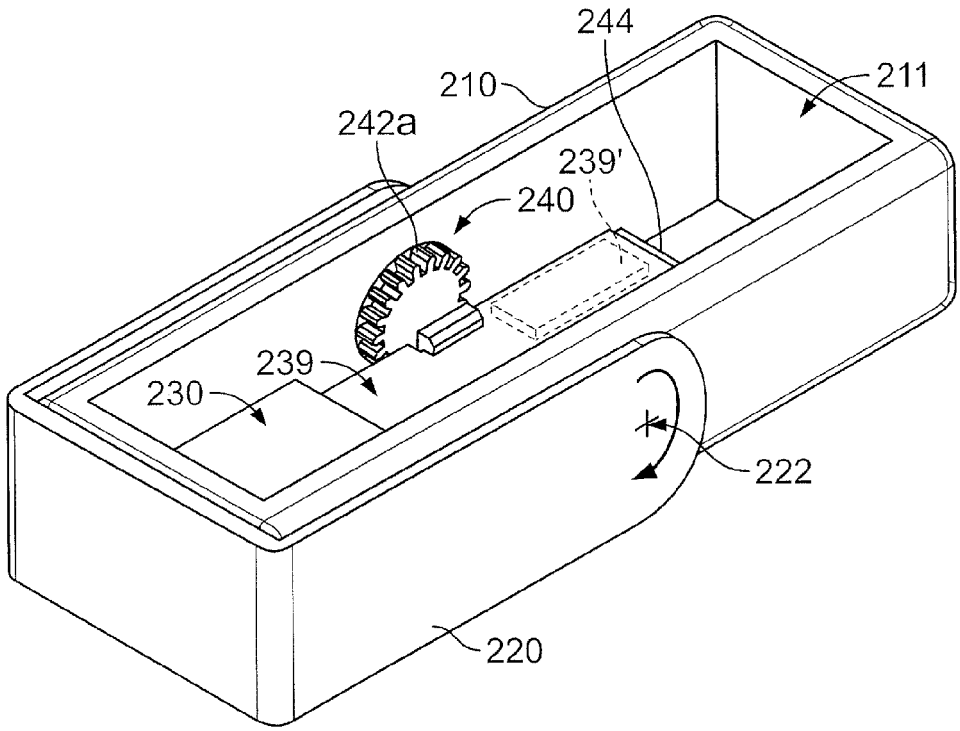
FIG. 4 is a perspective view of the USB modem device of FIG. 3 according to some embodiments of the present invention with the cover of the body and a rack and gear mechanism in the closed position.
Figure 5:
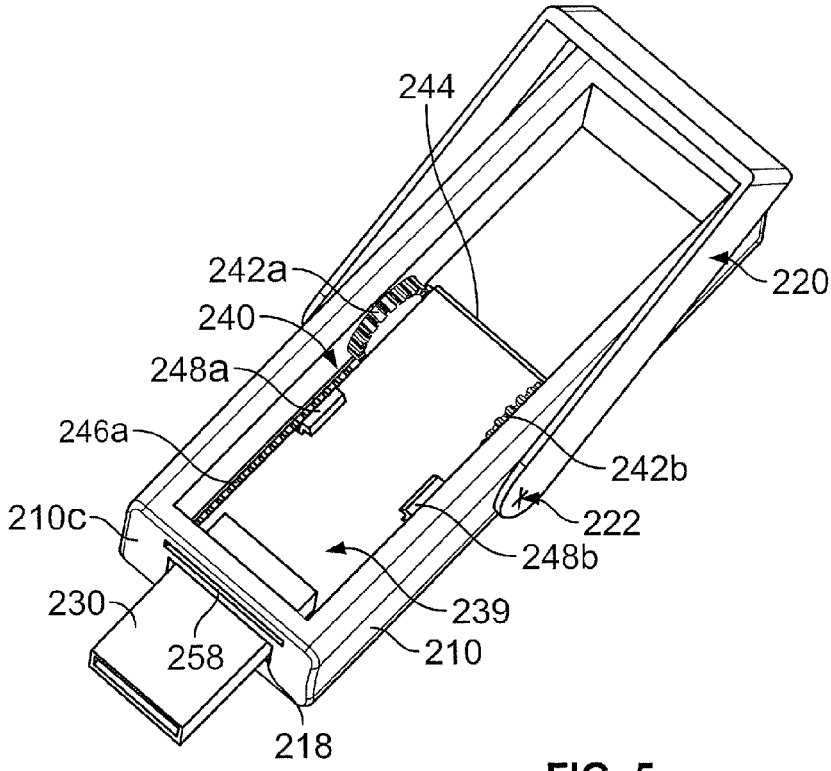
FIG. 5 is a perspective view of the USB modem device of FIG. 4 with the rack and gear mechanism in the open position.

FIGS. 4 and 5 are perspective views of the USB modem device 200 of FIG. 3 with the cover 212 removed to show a linkage mechanism, shown as a rack and gear mechanism 240, configured to translate the rotational movement of the flip member 220 from the closed position of FIG. 4 to the open position of FIG. 5 to the linear movement extending the USB connector 230 from the retracted position of FIG. 4 to the extended position of FIG. 5. In FIGS. 4 and 5, the USB connector 230 is shown coupled to a printed circuit board (PCB) 239 that moves linearly with the USB connector 230. However, the PCB 239, which may include modem circuitry and/or the like, may also be maintained in a fixed position rather than moving with the USB connector 230. It will be understood that a second PCB 239' may be provided above the PCB 239 illustrated in FIGS. 4 and 5, to which a SIM/memory card inserted in the memory card slot 258 is connected. The second circuit board 239' may, for example, include a memory card circuit thereon that is operatively coupled to a memory card inserted in the memory card slot 218. The two PCBs 239, 239' may be operatively coupled, for example, by a flexible film connector, a cable and/or the like. The second PCB 239' may be fixedly connected, for example, to the body member 210 with the first PCB 239 moving relative thereto when the USB connector 230 is retracted/extended.

Figure 6:
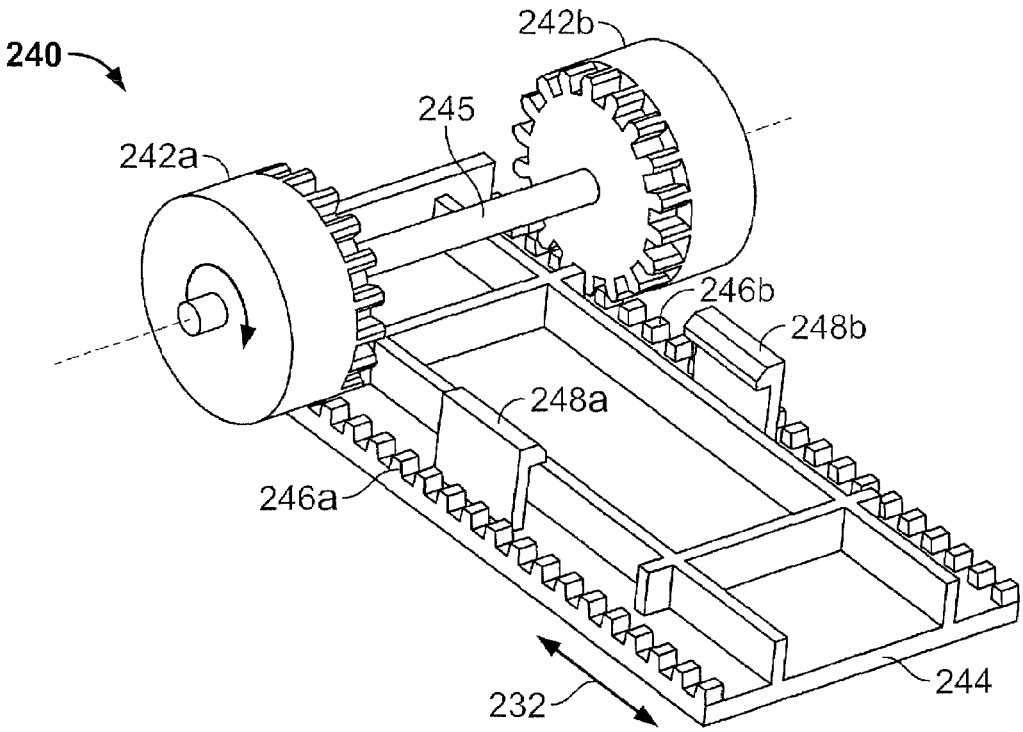
FIG. 6 is a perspective view illustrating the rack and gear mechanism of the USB modem device of FIGS. 4-5 according to some embodiments of the present invention.

FIG. 6 is a perspective view illustrating the rack and gear mechanism 240 of the USB modem device 200 of FIGS. 3-5 according to some embodiments of the present invention. As seen in the embodiments of FIGS. 4-6, the USB connector 230 is fixedly connected to the circuit board 239 and the circuit board 239 and USB connector 230 move linearly in a direction 232 (FIG. 6) between the extended position of the USB connector 230 shown in FIG. 5 and the retracted position of the USB connector 230 shown in FIG. 4. The USB connector 230 and PCB 239 are mounted to a sliding member 244 that is driven by gears 242*a*, 242*b* that rotate about the hinge axis 222.

In the embodiments as seen in FIGS. 4 and 5, the PCB 239 is placed into the sliding member 244 and retained by respective clips 248*a*, 248*b*. The rack and gear assembly 240 and the PCB 239 are positioned in the body 210 in a cavity 211. The gears 242*a*, 242*b* are coupled to the flip assembly 220 for rotation therewith about the hinge axis 222. While such an arrangement is shown by the positioning of the gears 242*a*, 242*b* on the hinge axis 222, it will be understood that the present invention is not limited to such a direct linkage configuration.

As best seen in FIG. 6, the sliding member 244 includes a first and second rack member 246*a*, 246*b* thereon. The racks 246*a*, 246*b* engage corresponding gears 242*a*, 242*b*, respectively. Thus, as the PCB 239 with the USB connector 230 fixed thereon is mounted to the sliding member 244, the sliding member 244 is coupled to the USB connector 230 for linear movement therewith when rotation of the gears 242*a*, 242*b* drives the corresponding rack members 246*a*, 246*b*. As such, the linkage mechanism 240 translates rotation of the flip member 220 between the closed and open positions to a desired linear advancement of the USB connector 230 between the retracted and the extended positions.

While a first and second gear (pinion) and corresponding unitary sliding member including first and second rack members are shown in the embodiments of FIG. 6, it will be understood a single gear and rack member may be provided in some embodiments, although the dual gear approach of FIG. 6 may be less prone to binding during operation.

Also shown in the rack and gear mechanism 240 of FIG. 6 is a metal shaft 245 extending between gears 242*a* and 242*b*. As will be described later herein, the metal shaft 245 may serve as part of an RF connection with a contact on the flip assembly 220 that is operatively coupled to an antenna therein and such a direct contact may be maintained in electrical contact in both open and closed positions of the flip member 220. For example, the contact on the flip assembly may be a spring contact engaging the metal shaft 245.

Figure 7A:
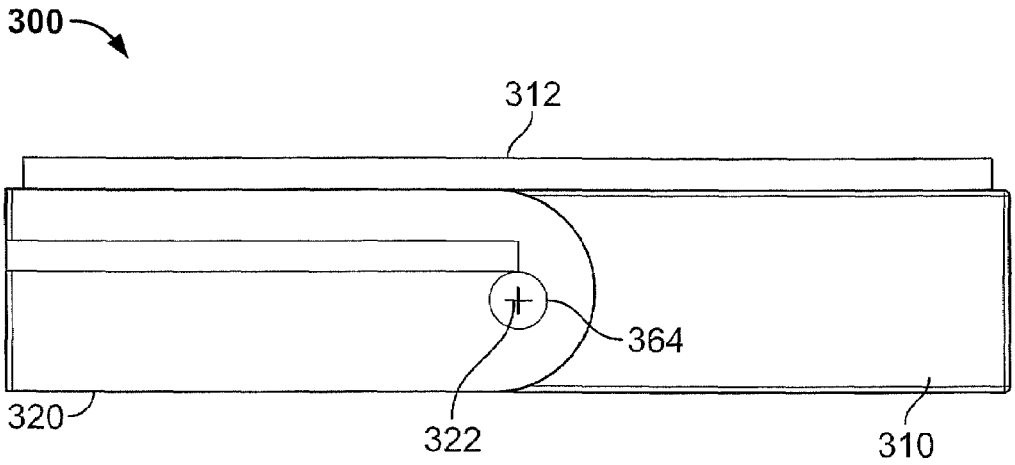
FIG. 7A is a side view of a USB modem device illustrating a direct antenna RF connection configuration according to some embodiments of the present invention.

FIGS. 7A to 12C illustrate antenna RF connection configurations according to various embodiments of the present invention. FIGS. 7A-7C illustrate direct contacts with centrally (proximate the pivot point/hinge axis) located contacts. A pair of linear antenna elements are shown in the flip cover/antenna assembly each extending from a center contact aligned with the binge axis on respective sides of the body of the USB modem device. While linear antenna elements are shown in FIGS. 7A-7C for purposes of explaining some embodiments of the present invention, it will be understood that other types of antennas, such as loop antennas, monopole antennas and/or the like may be used in some embodiments of the present invention and may operate in a USB modem device generally as described herein with reference to linear antenna elements. FIG. 7A is a side view, FIG. 7B is a perspective view with the flip cover/antenna assembly in the closed (stowed) position and FIG. 7C is a perspective view with the flip cover/antenna assembly in the engaged (open) position and the USB connector in the extended position. The direct contact may be, for example, a hard contact with a metallic shaft and/or a spring contact or the like and the RF connection may be provided on one or both sides of the hinge axis as will be described further below.

Figure 7B:
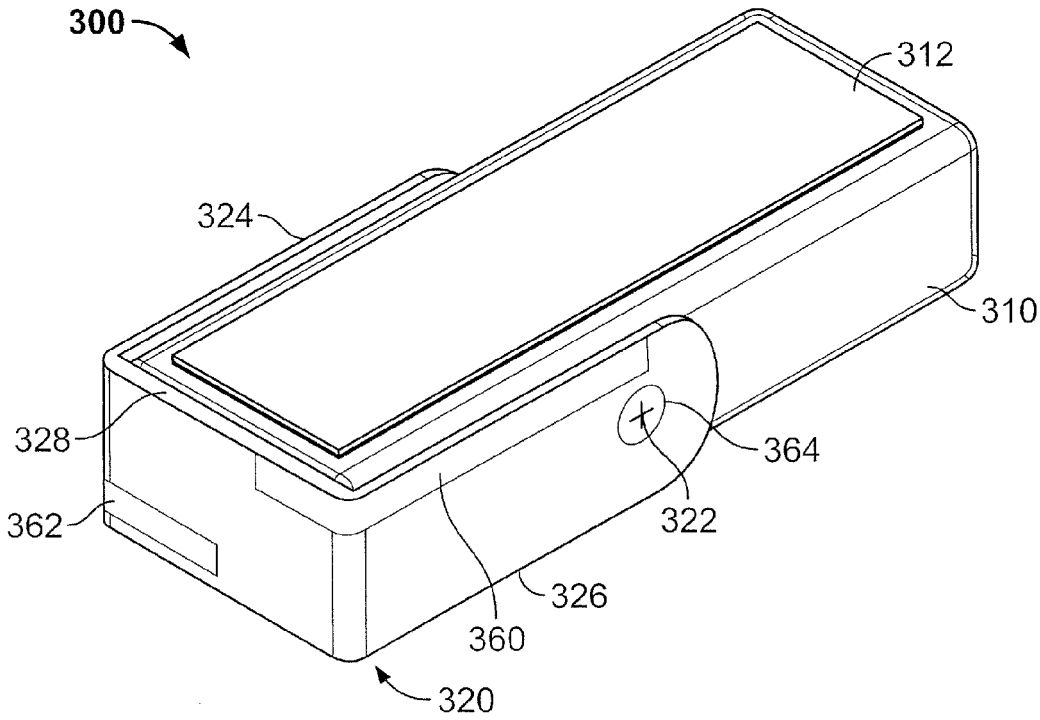
FIG. 7B is a perspective view of the USB modem device of FIG. 7A with a flip member in a closed position.
Figure 7C:
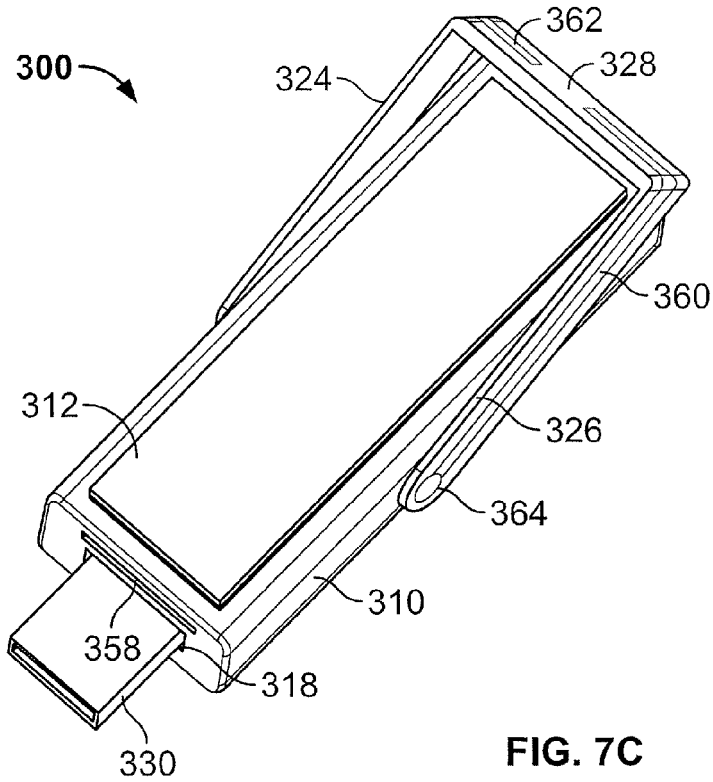
FIG. 7C is a perspective view of the USB modem device of FIG. 7C with the flip member in an open position.

As seen in FIGS. 7A through 7C, the USB modem device 300 includes a body member 310 and a flip member 320. A cover 312 is provided on the body member 310. The flip member 320 is pivotally connected to the body member 310 for rotational movement about a hinge axis 322. A direct RF connection contact 364 is schematically shown in the embodiments of FIGS. 7A through 7C that is centrally located proximate the hinge axis 322. The contact 364 provides an RF connection operatively coupling an antenna 360 positioned in a first aim 326 of the flip member 320 to modem circuitry in the body member 310. The antenna 360 is shown as a linear antenna in the embodiments of FIGS. 7A through 7C and a second linear antenna 362 is shown that extends in the second arm 324 of the flip member 320. It will be understood that the linear antennas 360, 362 are schematically illustrated in FIGS. 7A through 7C and, in some embodiments, they may be embedded within the flip member 320 and not visible to a user of the USB modem device 300. Furthermore, while illustrated as linear antennas, the present invention is not limited to the use of linear antennas included in the flip member 320. Furthermore, while a pair of antennas 360, 362 are shown that may be coupled to respective contacts forming RF connections on opposite sides of the body member 310, in some embodiments a single antenna on a more than two antennas may be provided in the flip member 320.

As also seen in FIGS. 7B and 7C, the linear antennas 360, 362 may include segments extending into a connecting member 328 that connects the first and second arms 326, 324 of the flip member 320 at ends thereof displaced from the hinge axis 322. As seen in FIG. 7C, the USB modem device 300 also includes a USB connector 330 that moves through an opening 318 in the body member 310 between extended and retracted positions and a memory card slot 358 proximate thereto, which features may generally operate in the same manner as was described with reference to liked numbered elements (230, 330, etc) described previously and such similar features will not be further described herein.

It will also be understood that the RF connection direct contact 364 may include a contact on the flip member 320 operatively coupled to the antenna 360 and an associated contact on the body member 310 that is operatively coupled to a modem circuit in the body member 310. For the embodiments illustrated in FIGS. 7A through 7C, the respective contacts may be in contact with each other providing an electrical connection in both the closed and open positions of FIGS. 7B and 7C but, in other embodiments, an electrical connection is only provided in the open position as will be described with reference to various offset contact embodiments shown in FIGS. 10A through 12C.

Figure 8B:
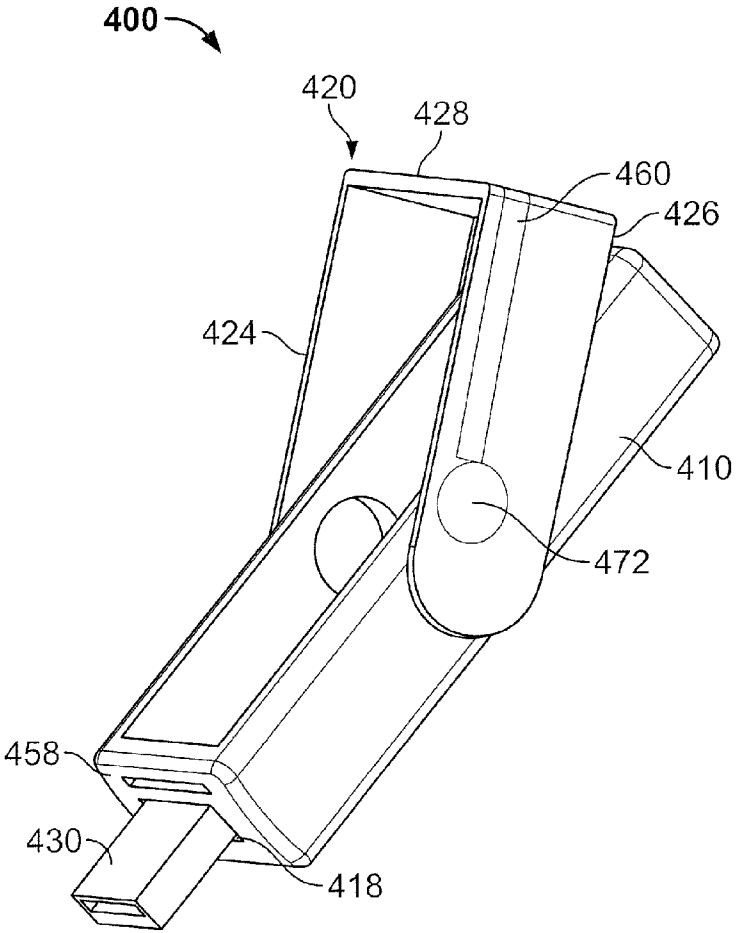
FIGS. 8A and 8B are perspective views illustrating capacitive coupling of a USB modem device antenna according to some embodiments of the present invention.
Figure 8A:
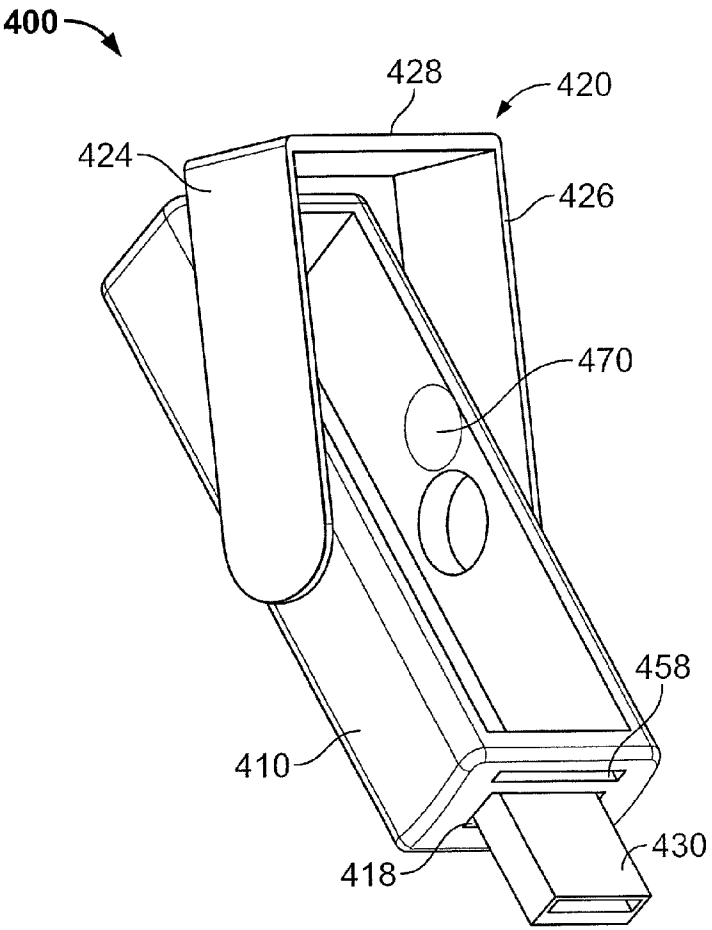

FIGS. 8A and 8B are perspective views illustrating capacitive coupling according to some embodiments of the present invention. In the embodiments of FIGS. 8A-8B, the RF connection may be made via a pair of arbitrarily shaped metallic pads using capacitive coupling (no metallic contacts between two pads). The pads can be centered on or offset from the hinge axis. Capacitive coupling may be provided on one or both sides of the hinge axis.

As shown in the embodiments of FIGS. 8A and 8B, the USB modem device 400 includes a body member 410, a flip member 420 and a USB connector 430 that may operate substantially as described previously with reference to like numbered elements in the embodiments of FIGS. 2 through 6. Similarly, the body member 410 is shown as including an opening 418 in an end thereof through which the USB connector 430 extends and a memory card slot 458 proximate thereto. The flip member 420 is shown as including first and second arm 424, 426 with a connecting member 428 extending therebetween. A linear antenna element 460 is also shown schematically in FIG. 8B. It will be understood that additional antenna elements or antennas other than linear antennas may be used in various embodiments of the present invention.

The embodiments of FIGS. 8A and 8B differ from the embodiments of FIGS. 7A through 7C in the use of capacitive coupling of the antenna element 460 to modem circuitry in the body member 410. As schematically shown in FIGS. 8A and 8B, the capacitive coupling RF connection includes a first electrode 472 on the flip assembly 420 that is operatively coupled to the antenna 460 and a second electrode 470 on the body member 410 that is operatively coupled to the modem circuit within the body member 410 (not shown in FIGS. 5A and 5B). The electrodes 470, 472 are capacitively coupled without direct contact therebetween. While shown as offset in FIGS. 8A and 8B, the electrodes 470, 472 may be centrally located to provide an RF connection in both the open and closed positions or may be offset to provide capacitive coupling only in the open position of the flip member 420 shown in FIGS. 8A and 8B. In addition, while only a single pair of electrodes 470, 472 are shown in FIGS. 8A and 8B, a similarly arranged pair of associated electrodes may be provided on an opposite side of the body member and different arm of the flip member 420 to provide capacitive coupling at multiple points. Each of the capacitive couplings may, in some embodiments, be associated with different antenna elements included in the flip member 420.

Figure 9B:
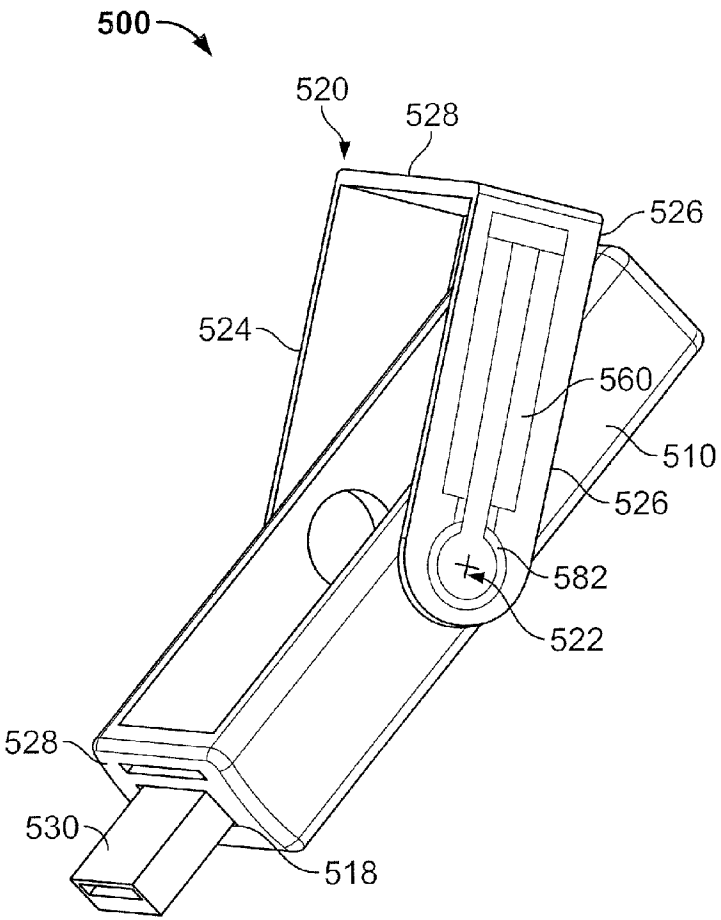
FIGS. 9A and 9B are perspective views illustrating inductive coupling of a USB modem device antenna according to some embodiments of the present invention.
Figure 9A:
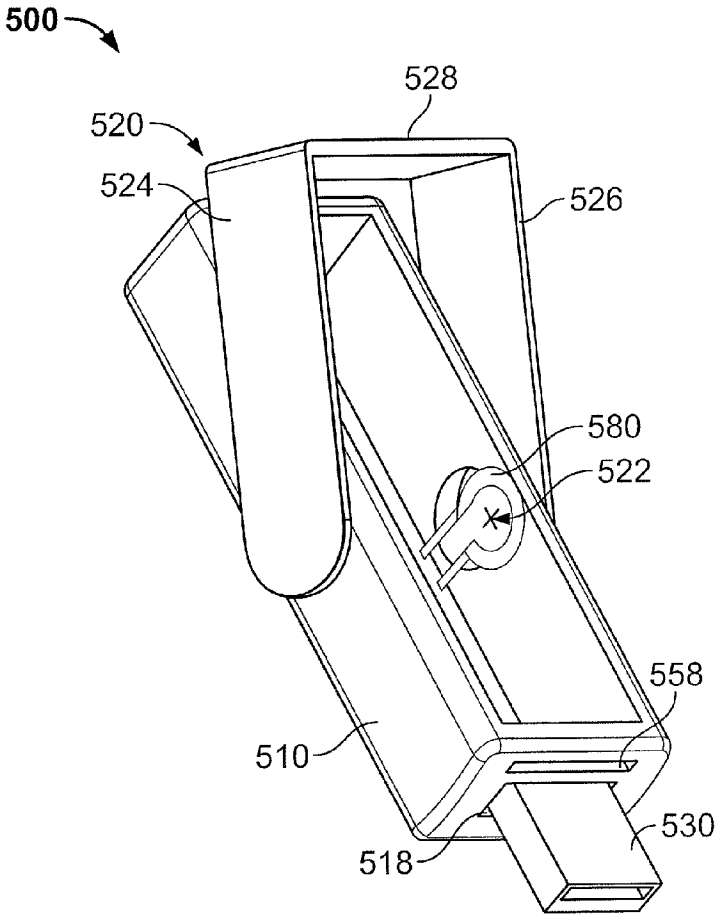

FIGS. 9A and 9B are perspective views illustrating inductive coupling according to some embodiments of the present invention. In the embodiments of FIGS. 9A-9B, the RF connection may be made via a pair of metallic coils (arbitrary number of turns) using inductive coupling (no metallic contacts between two coils). The coils can be centered or offset to the hinge axis. Inductive coupling may be provided on one or both sides of hinge axis.

A USB modem device 500 includes a body member 510, a flip member 520 and a USB connector 530 that may operate substantially as described with respect to like numbered elements with reference to FIGS. 2-6. Similarly, an opening 518 is shown in an end of the body member 510 through which the USB connector travels linearly and a memory card slot 558 in shown in the end proximate the USB connector 530. Similarly, the illustrated flip member 520 includes first and second arms 524, 526 with a connecting member 528 extending therebetween.

The embodiments of FIGS. 9A and 9B differ from the previously described embodiments in that the antenna element 560 is shown as a loop antenna in FIG. 9B. In addition, the RF connection providing inductive coupling between the antenna element 560 and modem circuitry (not shown) in the body member 510 includes a first coil 582 on the flip member 520 and a second coil 580 on the body member 510 that is operatively coupled to the modem circuit. The first and second electrodes 582, 580 are inductively coupled without direct contact therebetween at least in the open position shown in FIGS. 9A and 9B. As shown in the embodiments of FIGS. 9A and 9B, the coils 580, 582 are centrally located proximate the hinge axis 522 and may be capacitively coupled without direct contact therebetween in both the closed and open positions of the flip member 520. However, it will be understood that offset coils may be used that are only inductively coupled in the open position of the flip member 520 shown in FIGS. 9A and 9B.

Figure 10A:
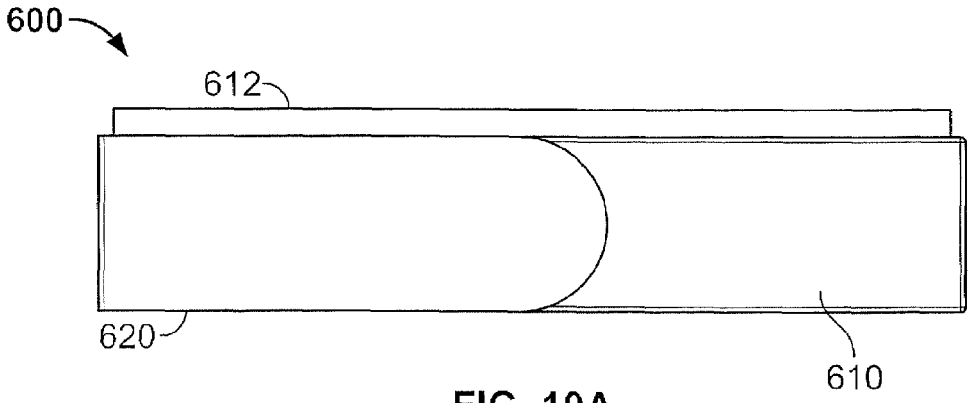
FIGS. 10A and 10C are side views illustrating offset contacts for a USB modem device antenna according to some embodiments of the present invention.
Figure 10B:
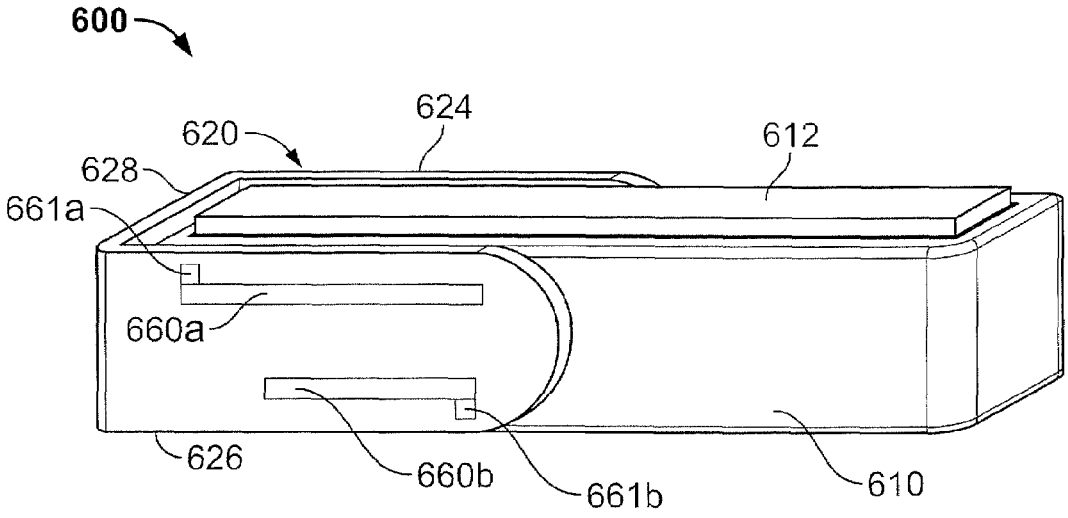
FIG. 10B is a perspective view illustrating the contacts of FIGS. 10A and 10C with the flip member in the closed position.
Figure 10C:
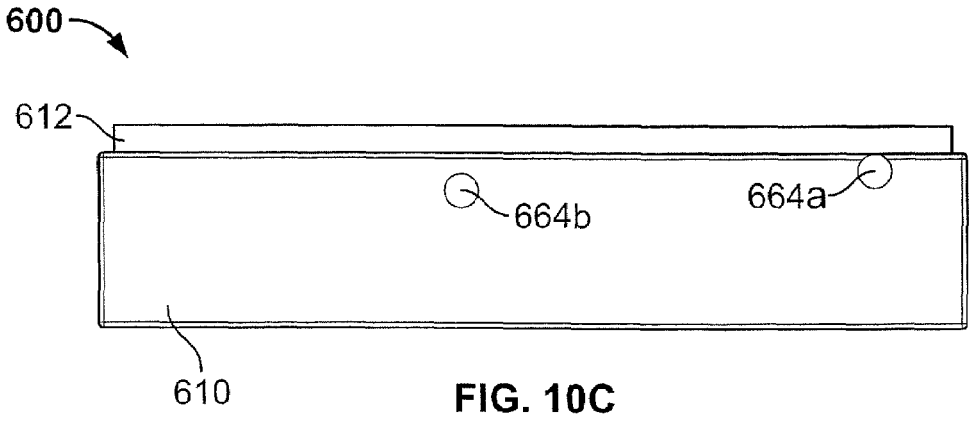
Figure 11A:
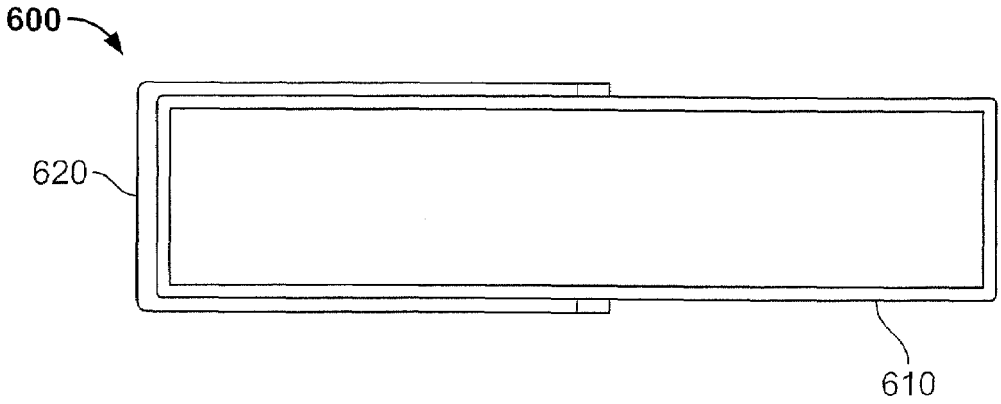
FIG. 11A through 11C are top views of the contact arrangement of FIGS. 10A-10C.
Figure 11B:
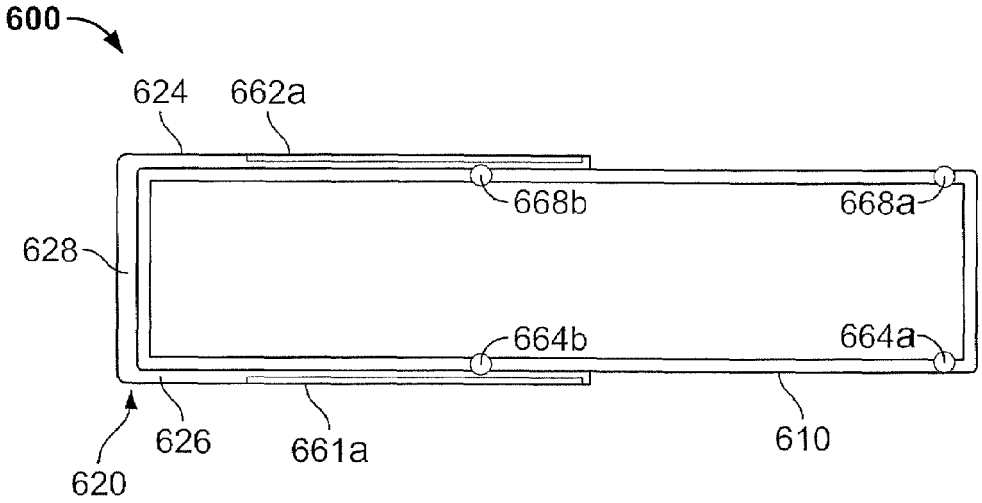
Figure 11C:
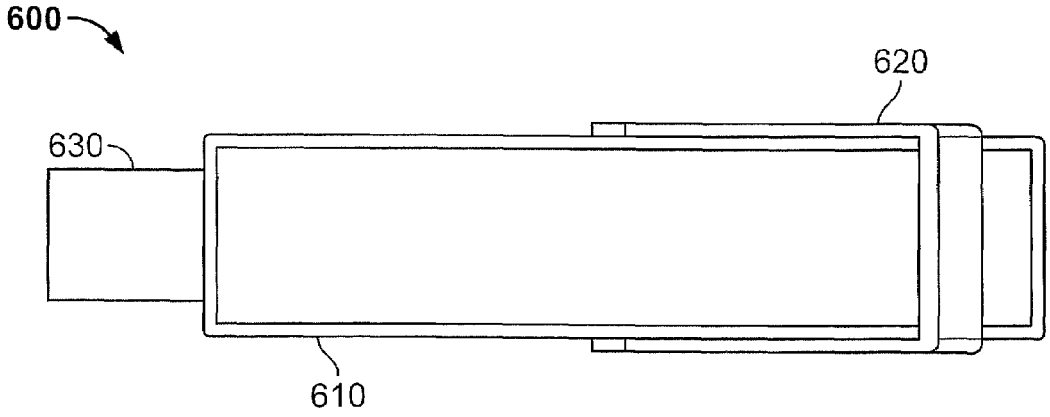
Figure 12A:
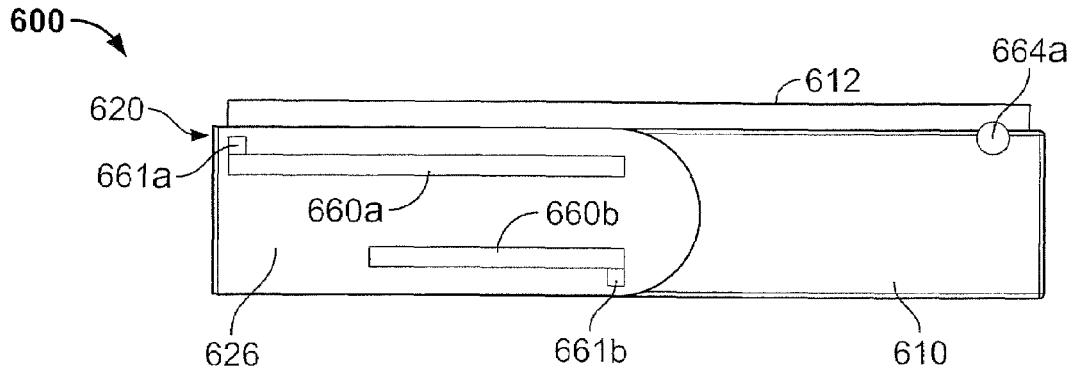
FIGS. 12A-12C are side views of the USB modem device of FIGS. 10A-10C and 11A-11C.
Figure 12B:
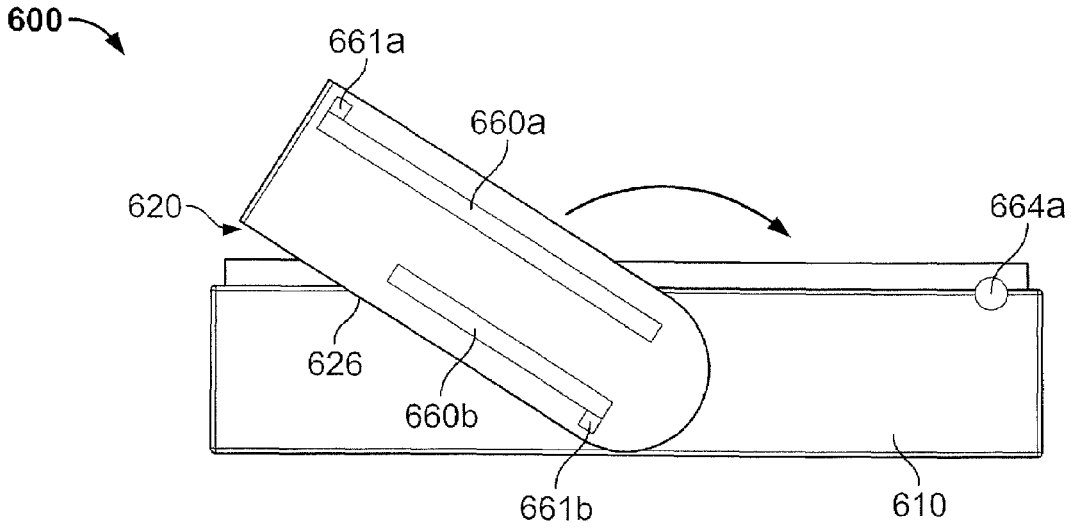
Figure 12C:
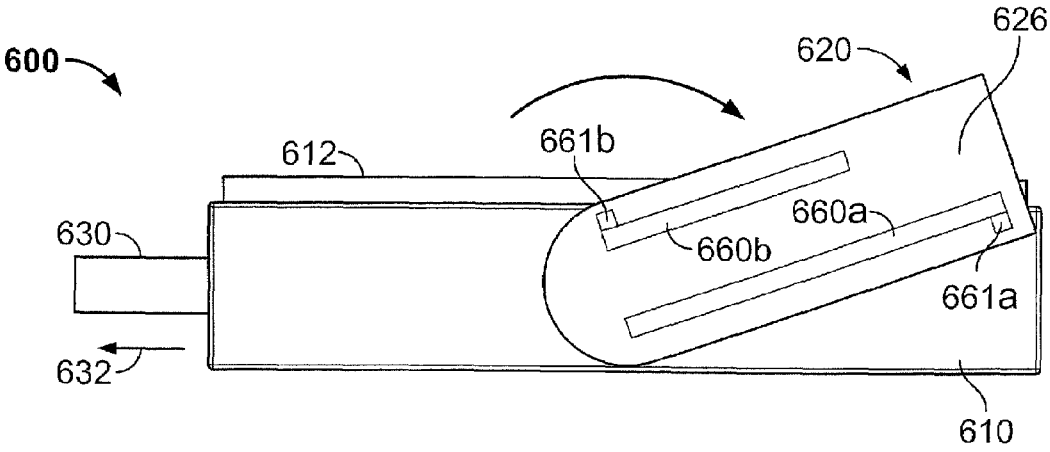

FIGS. 10A-10C, 11A-11C and 12A-12C illustrate offset contacts according to some embodiments of the present invention. FIGS. 10A and 10C are side views, with the flip cover/antenna assembly not shown in FIG. 10C to illustrate the contact points. FIG. 10B is a perspective view illustrating two linear antennas in the flip cover/antenna assembly and the flip cover/antenna assembly in the closed (stowed) position. FIG. 11A-11C are top views of the contact arrangement of FIGS. 10A-10C. The flip cover/antenna assembly is shown in the closed (stowed) position in FIGS. 11A and 11B and the open (engaged) position in FIG. 1C. FIGS. 12A-12C are side views of the USB modem device of FIGS. 10A-10C and 11A-11C. The flip cover/antenna assembly is shown in the closed (stowed) position in FIG. 12A, rotated to the open (engaged) position with the USB connector in the extended position in FIG. 12C and an intermediate position in FIG. 12B.

As shown in the embodiments of FIGS. 10A-12C, the USB modem device 600 includes a body member 610, a flip member 620 and a USB connector 630. A cover 612 is shown on the body member 610. The flip member 620 is shown as including first and second arms 624, 626 and a connecting member 628 extending between ends of the arms 624, 626. As these features of the embodiments of FIGS. 10A-12C may operate generally as described with reference to the like numbered elements of FIGS. 2-6, they need not be described further herein.

The illustrations of FIGS. 10A-12C show an offset contact arrangement to a first linear antenna 660*a* and a second linear antenna 660*b* each of which is located in the first arm 626 of the flip member 620. Respective contact portions 661*a* and 661*b* are shown on the linear antennas 660*a*, 660*b*. It will be understood that the illustration of the linear antenna 660*a*, 660*b* is schematic in nature for purposes of illustrating the offset contact arrangements. Also shown in the embodiments of FIGS. 10A-12C are respective offset RF connection contacts 664*a* and 664*b*. As seen in FIG. 11B, a corresponding pair of offset contacts 668*a*, 668*b* may be included on an opposite side of the body member 610 for connection to antenna elements in the arm 624 of the flip member 620. As the operation of the contacts 668*b*, 668*a* in connection with one or more antennas, such as the antenna element 662*a* in the arm 624, may proceed substantially as will be described with reference to the contacts 664*a* and 664*b*, the contact 668*a*, 668*b* need not be further discussed herein.

As shown for the embodiments of FIGS. 10A-12C, an RF connection between the linear antenna 660*a* and 660*b* and corresponding modem circuitry in the body member 610 is not provided in the closed position of the flip member 620 but only in the open position of the flip member 620 illustrated in FIGS. 11C and 12C. As best seen by reference to FIGS. 10C and 12C, in the open position illustrated for the flip member 620 in FIG. 12C, the respective contact portions 661*a* aligns with and forms a connection with the contact 664*a* in the body member 610 and the contact 661*b* associated with the antenna 660*b* aligns with and forms a connection with the contact 664*b* in the body member 610. Thus, the lower linear antenna element 660*b* in FIG. 10B would engage the offset contact point 664*b* of FIG. 10C that is closer to the hinge axis, while the upper linear antenna 660*a* would engage the offset contact point 664*a* further from the hinge axis when the flip member 620 is in the open position of FIG. 12C. As such, an arrangement may be provided in which the RF connection is engaged only in the open position. The engaged connection may be a direct connection, capacitive connection or inductive coupling as described previously herein.

Figure 13:
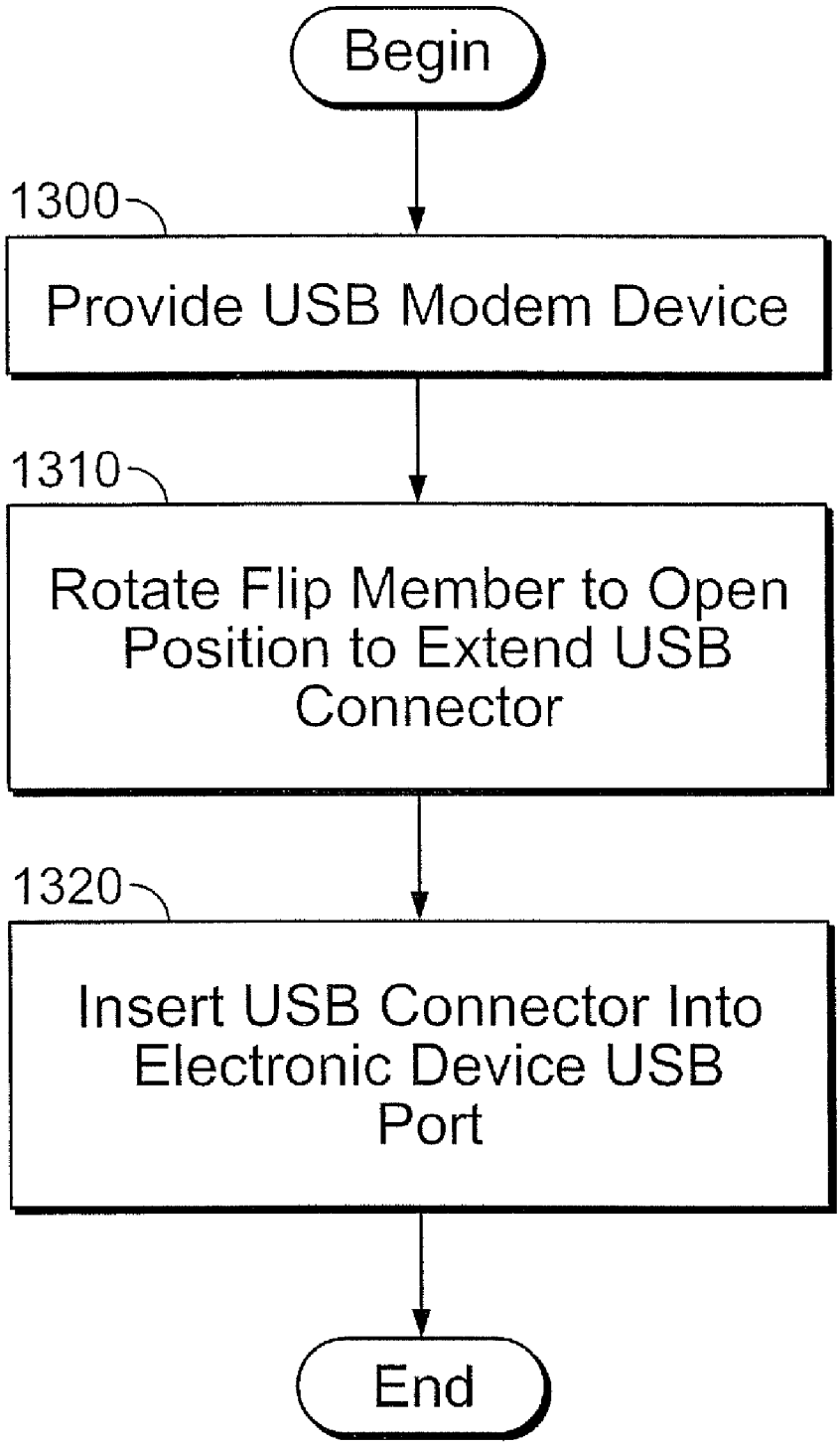
FIG. 13 is a flowchart illustrating a method for configuring an electronic device for wireless communication according to some embodiments of the present invention.

A method for configuring an electronic device for a wireless communication in accordance with some embodiments of the present invention will now be described with reference to the flowchart illustration of FIG. 13. For the embodiments illustrated in FIG. 13, operations begin at block 1300 by providing a hand-held USB modem device including a flip member with an antenna element. The hand-held USB modem device further includes a USB connector linked to the flip member for linear movement to an extended position response to rotation of the flip member to an open position. The flip member covers an opening through which the USB connector linearly travels in a closed position of the flip member.

The flip member is rotated to the open position to uncover the opening and extend the USB connector to its extended position (block 1310). The extended USB connector is inserted into a USB port of the electronic device to activate the USB modem device and configure the electronic device for wireless communication through the USB modem device (block 1320). As was described previously, rotation of the flip member at block 1310 may further electronically couple the antenna element to a modem circuit of the USB modem device in some embodiments of the present invention where the antenna element is only coupled in the open position.

In the drawings and specification, there have been disclosed embodiments of the invention and, although specific terms are employed, they are used in a generic and descriptive sense only and not for purposes of limitation, the scope of the invention being set forth in the following claims.

That which is claimed is:

1. A Universal Serial Bus (USB) modem device, comprising:

a body member;

a flip member including an antenna element, the flip member being rotatably coupled to the body member for movement about a hinge axis between a closed position and an open position;

a USB connector movably mounted in the body member for movement between an extended position and a retracted position relative to the body member; and a linkage mechanism in the body member coupling the flip member and the USB connector so that movement of the flip member between the open position and the closed position moves the USB connector between the extended position and the retracted position.

2. The USB modem device of claim 1, further comprising:

a circuit board positioned in the body member;

modem circuit on the circuit board; and a Radio Frequency (RF) connection operatively coupling the antenna to the modem circuitry.

3. The USB modem device of claim 2, wherein the USB connector is fixedly connected to the circuit board and wherein the circuit board and the USB connector move together linearly between the extended position and the retracted position.

4. The USB modem device of claim 2, wherein the RF connection comprises a direct connection comprising a contact on the flip member operatively coupled to the antenna and an associated contact on the body member operatively coupled to the modem circuit and wherein the contact on the flip member and the associated contact on the body member are in contact only in the open position.

5. The USB modem device of claim 4, wherein the antenna comprises a first antenna and a second antenna and wherein the flip member comprises:

a first arm extending from the hinge axis proximate a first side of the body member to an end thereof displaced from the hinge axis, the first arm including the first antenna;

a second arm extending from the hinge axis proximate a second side of the body member to an end thereof displaced from the hinge axis, opposite the first side, the second arm including the second antenna; and a connecting member extending between the end of the first arm and the end of the second arm, the connecting member in the closed position being positioned adjacent an end of the body member extending between the first and second side of the body member and covering a USB connector opening in the end of the body member through which the USB connector extends in the extended position, and wherein the contact on the flip member comprises a first contact operatively coupled to the first antenna and a second contact coupled to the second antenna and wherein the associated contact comprises a first associated contact on the first side of the body member and a second associated contact on the second side of the body member.

6. The USB modem device of claim 5, wherein the body member further comprises a memory card slot in the end of the body member proximate the USB connector opening and wherein the connecting member covers the memory card slot in the closed position and wherein the circuit board further includes a memory card circuit configured to operatively engage a memory card inserted in the memory card slot.

7. The USB modem device of claim 2, wherein the linkage mechanism includes a metal shaft extending along the hinge axis to which the flip member is fixedly coupled and wherein the RF connection comprises a direct connection comprising a contact on the flip member operatively coupled to the antenna that contacts the metal shaft in both the open position and the closed position.

8. The USB modem device of claim 7, wherein the contact on the flip member comprises a spring contact.

9. The USB modem device of claim 2, wherein the RF connection comprises a capacitive coupling including a first electrode on the flip member operatively coupled to the antenna and a second electrode on the body member operatively coupled to the modem circuit and wherein the first and second electrode are capacitively coupled without direct contact therebetween in the open position.

10. The USB modem device of claim 9, wherein the first electrode and the second electrode are centrally located proximate the hinge axis and wherein the first and second electrode are capacitively coupled without direct contact therebetween in the closed position and the open position.

11. The USB modem device of claim 9, wherein the first electrode and the second electrode are positioned at locations offset from the hinge axis and wherein the first and second electrode are capacitively coupled without direct contact therebetween only in the open position.

12. The USB modem device of claim 2, wherein the RF connection comprises an inductive coupling including a first coil on the flip member operatively coupled to the antenna and a second coil on the body member operatively coupled to the modem circuit and wherein the first and second electrode are inductively coupled without direct contact therebetween in the open position.

13. The USB modem device of claim 12, wherein the first coil and the second coil are centrally located proximate the hinge axis and wherein the first and second coil are capacitively coupled without direct contact therebetween in the closed position and the open position.

14. The USB modem device of claim 12, wherein the antenna comprises a loop antenna.

15. The USB modem device of claim 2, wherein the antenna comprises a first antenna and a second antenna and wherein the flip member comprises:

a first arm extending from the hinge axis proximate a first side of the body member to an end thereof displaced from the hinge axis, the first arm including the first antenna;

a second arm extending from the hinge axis proximate a second side of the body member to an end thereof displaced from the hinge axis, opposite the first side, the second arm including the second antenna; and a connecting member extending between the end of the first arm and the end of the second arm, the connecting member in the closed position being positioned adjacent an end of the body member extending between the first and second side of the body member and covering a USB connector opening in the end of the body member through which the USB connector extends in the extended position, wherein the USB connector is fully contained within the body member in the retracted position with the connecting member covering the USB connector opening.

16. The USB modem device of claim 15, wherein the body member further comprises a memory card slot in the end of the body member proximate the USB connector opening and wherein the connecting member covers the memory card slot in the closed position and wherein the circuit board further includes a memory card circuit configured to operatively engage a memory card inserted in the memory card slot.

17. The USB modem device of claim 16, wherein the circuit board comprises a first circuit board and a separate second circuit board and wherein the USB connector is connected to the first circuit board and wherein the modem circuit is on the first circuit board and the memory card circuit is on the second circuit board and wherein the first circuit board is electrically connected to the second circuit board.

18. The USB modem device of claim 16, wherein the linkage mechanism comprises a rack and gear mechanism that translates rotational movement of the flip member between the open and closed position to linear movement of the USB connector between the extended and retracted position.

19. The USB modem device of claim 18, wherein the rack and gear mechanism comprises:

a gear coupled to the flip member for rotation therewith about the hinge axis; and a sliding member including a rack member thereon, the rack member engaging the gear and the sliding member being coupled to the USB connector for linear movement therewith when rotation of the gear linearly drives the rack member.

20. The USB modem device of claim 18, wherein the rack and gear mechanism comprises:

a first gear coupled to the first arm proximate the first side of the body member for rotation therewith about the hinge axis;

a second gear coupled to the second arm proximate the second side of the body member for rotation therewith about the hinge axis; and a sliding member including a first and second rack member thereon, the first rack member engaging the first gear and the second rack member engaging the second gear, wherein the sliding member is coupled to the USB connector for linear movement therewith when rotation of the first gear linearly drives the first rack member and rotation of the second gear linearly drives the second rack member.

21. The USB modem device of claim 1, wherein the linkage mechanism comprises a rack and gear mechanism that translates rotational movement of the flip member between the open and closed position to linear movement of the USB connector between the extended and retracted position.

22. A method for configuring an electronic device for wireless communication, the method including:

providing a handheld USB modem device including a flip member including an antenna element and a USB connector linked thereto for linear movement to an extended position responsive to rotation of the flip member to an open position, the flip member covering an opening through which the USB connector linearly travels in a closed position of the flip member;

rotating the flip member to the open position to uncover the opening and extend the USB connector to the extended position; and inserting the extended USB connector into a USB port of the electronic device to activate the USB modem device and configure the electronic device for wireless communication through the USB modem device.

23. The method of claim 22 wherein rotating the flip member electronically couples the antenna element to a modem circuit of the USB modem device.

* * * * *